US008495976B2

(12) United States Patent
Shimasaki

(10) Patent No.: US 8,495,976 B2
(45) Date of Patent: Jul. 30, 2013

(54) OIL CONTROL VALVE AND HYDRAULIC CONTROL APPARATUS

(75) Inventor: Shinobu Shimasaki, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 75 days.

(21) Appl. No.: 13/215,839

(22) Filed: Aug. 23, 2011

(65) Prior Publication Data

US 2012/0048410 A1 Mar. 1, 2012

(30) Foreign Application Priority Data

Aug. 25, 2010 (JP) ..... 2010-188500

(51) Int. Cl.
*F01L 1/34* (2006.01)

(52) U.S. Cl.
USPC ..... 123/90.17; 137/625.69; 137/625.67

(58) Field of Classification Search
USPC ..... 123/90.17; 137/625.69, 625.67, 137/625.68; 251/368
See application file for complete search history.

(56) References Cited

U.S. PATENT DOCUMENTS 5,904,107 A * 5/1999 Kester ..... 111/135
6,729,283 B2 * 5/2004 Simpson et al. ..... 123/90.17
7,841,361 B2 11/2010 Daut

FOREIGN PATENT DOCUMENTS

JP 11002354 A 1/1999
JP 2004-108370 A 4/2004
JP 2008-528891 A 7/2008
JP 2010-127252 A 6/2010

OTHER PUBLICATIONS

Office Action issued on Jun. 19, 2012 in corresponding Japanese Application No. 2010-188500 and partial English translation thereof.

* cited by examiner

*Primary Examiner* — Zelalem Eshete
(74) *Attorney, Agent, or Firm* — Gifford, Krass, Sprinkle, Anderson & Citkowski, P.C.

(57) ABSTRACT

An oil control valve includes: a housing that is connected to an oil passage via which an oil is fed to and drained from a hydraulic device; an elongated spool that changes a state of oil feeding-drainage for the hydraulic device by moving in the housing; and a drain passage which is formed in the spool such that the drain passage extends in an axial direction of the spool and an outlet of the drain passage is provided at a radial side face of an axial end portion of the spool, and via which the oil that has entered the housing from the hydraulic device is drained, wherein the spool includes an elongated spool body, and an attachment that is separate from the spool body and is fixed at an axial end portion of the spool body.

8 Claims, 6 Drawing Sheets

OIL CONTROL VALVE AND HYDRAULIC CONTROL APPARATUS

INCORPORATION BY REFERENCE

This application claims priority to Japanese Patent Application No. 2010-188500 filed on Aug. 25, 2010, which is incorporated herein by reference in its entirety including the specification, drawings and abstract.

BACKGROUND OF THE INVENTION

1. Field of the Invention

The invention relates to an oil control valve and a hydraulic control apparatus.

2. Description of Related Art

For higher fuel economies, higher outputs, and so on, internal combustion engines for vehicles (e.g., automobiles) which have a hydraulic variable valve timing mechanism (an example of "hydraulic device") used for variably controlling the operation timing of engine valves (intake valves and/or exhaust valves) are now in practical use. In such internal combustion engines, a moveable member fixed at one end of the camshaft is driven through oil feeding to and oil drainage from the variable valve timing mechanism, whereby the rotational phase of the camshaft relative to the crankshaft shifts. Thus, by shifting the rotational phase of the camshaft relative to the crankshaft, the operation timing of the valves of the internal combustion engine is variably controlled.

Oil feeding and oil drainage for a hydraulic device, such as the variable valve timing mechanism described above, are performed through a plurality of oil passages constituting a hydraulic circuit connecting the hydraulic device to an oil pump. In such a hydraulic circuit, an oil control valve that is driven by an actuator to change the state of oil feeding to the hydraulic device through the oil passages and the state of oil drainage from the hydraulic device through the oil passages (will hereinafter be collectively referred to as "the state of oil feeding-drainage" where necessary) is provided midway in the oil passages, and the state of oil feeding-drainage for the hydraulic device is changed by driving the oil control valve using the actuator. In this way, the hydraulic device operates hydraulically. It is to be noted that the oil control valve and the actuator together serve as a hydraulic control apparatus for controlling the oil pressure applied to the hydraulic device to drive the hydraulic device.

As an oil control valve for such a hydraulic control apparatus, for example, the one described in Japanese Patent Application Publication No. 2010-127252 may be used. The oil control valve described in Japanese Patent Application Publication No. 2010-127252 includes a housing having a plurality of ports connectable to the respective oil passages and an elongated spool disposed in the housing. The state of oil feeding-drainage for the hydraulic device is changed by changing the state of connections between the respective ports of the housing by adjusting the axial position of the spool.

Further, an oil control valve is known in which a drain passage for draining the oil that has entered a housing from a hydraulic device is formed in a spool such that the same passage extends in the axial direction of the spool. Such a drain passage in a spool is provided to, for example, obtain a larger passage area for improving the efficiency of oil drainage through the drain passage, and secure a region where the drain passage is formed. It is to be noted that such an oil control valve is driven by the spool being axially moved under the pressure applied to the axial end face of the spool from the actuator. In such a case, the outlet of the drain passage, which is formed in the spool as mentioned above, cannot be provided at the axial end face of the spool, and thus it is provided at a radial side face of the axial end portion of the spool.

Meanwhile, in the above-described structure in which the drain passage extending in the axial direction of the spool is formed in the spool of the oil control valve and the outlet of the drain passage is provided at the radial side face of the axial end portion of the spool, inevitably, the internal structure of the axial end portion of the spool is complicated, and therefore there is a possibility of an increase in the time and effort required for fabricating the inside of the axial end portion of the spool, resulting in an increase in the manufacturing cost.

SUMMARY OF THE INVENTION

The invention provides an oil control valve and a hydraulic control apparatus that are structured such that the inside of an axial end portion of a spool can be easily fabricated.

The first aspect of the invention relates to an oil control valve including: a housing that is connected to an oil passage via which an oil is fed to and drained from a hydraulic device; an elongated spool that changes a state of oil feeding-drainage for the hydraulic device by moving in the housing; and a drain passage which is formed in the spool such that the drain passage extends in an axial direction of the spool and an outlet of the drain passage is provided at a radial side face of an axial end portion of the spool, and via which the oil that has entered the housing from the hydraulic device is drained, wherein the spool includes an elongated spool body, and an attachment that is separate from the spool body and is fixed at an axial end portion of the spool body. According to this oil control valve, the inside of the attachment, which corresponds to the inside of the axial end portion of the spool, is fabricated while the attachment is separate from the spool body. Therefore, the inside of the axial end portion of the spool can be easily fabricated.

The oil control valve described above may be such that a wear resistance of the attachment is higher than a wear resistance of the spool body. According to this structure, it is possible to reduce the wearing of the spool caused by the axial end face of the spool rubbing when the spool axially moves under the pressure applied to the same end face of the spool. Further, since the attachment and the spool body are separate from each other, the higher wear resistance at the axial end portion of the spool can be achieved by increasing only the wear resistance of the attachment. If the attachment and the spool body were integrally formed, it would be necessary to increase the wear resistance of the entire spool including the attachment and the spool body, and this may result in an increase in the manufacturing cost. According to the structure described above, in contrast, such an increase in the manufacturing cost can be avoided.

The oil control valve described above may be such that the attachment is heat-treated such that the wear resistance of the attachment is higher than the wear resistance of the spool. According to this structure, since the attachment and the spool body are separate from each other, the heating treatment can be applied to the attachment while the attachment is separate from the spool body. If the attachment and the spool body were integrally formed, it would be necessary to apply the heating treatment to the entire spool including the attachment and the spool body, and the heating treatment may distort the spool body, resulting, possibly, in a decrease in the accuracy in forming the spool (the spool body). According to the above-described structure, such a decrease in the accuracy in forming the spool can be avoided by applying the heating treatment to the attachment while the attachment is separate from the spool body.

The oil control valve described above may be such that the attachment is produced by pressing a plate material. According to this structure, a communication portion is formed in the attachment, and the communication portion serves as the outlet of the drain passage, which is provided at the radial side face of the axial end portion of the spool, when the attachment is fixed at the spool body. Therefore, an attachment having such a communication portion can be easily produced.

The second aspect of the invention relates to a hydraulic control apparatus including: an oil control valve that is fixed at an end portion of a camshaft of an internal combustion engine and that changes a state of oil feeding-drainage for a hydraulic device; and an actuator that is provided outside the camshaft and that drives the oil control valve, wherein: the oil control valve is driven by moving an elongated spool, which is disposed in a housing, in an axial direction of the spool by a pressure applied to an axial end face of the spool from the actuator; a drain passage via which an oil that has entered the housing from the hydraulic device is drained is formed in the spool such that the drain passage extends in the axial direction of the spool and an outlet of the drain passage is provided at a radial side face of an axial end portion of the spool; and the spool of the oil control valve includes an elongated spool body, and an attachment that is separate from the spool body and is fixed at an axial end portion of the spool body on a side where the actuator is present. According to this hydraulic control apparatus, the inside of the attachment, which corresponds to the inside of the axial end portion of the spool, can be fabricated while the attachment is separate from the spool body. Therefore, the inside of the axial end portion of the spool can be easily fabricated.

The hydraulic control apparatus described above may be such that a wear resistance of the attachment is higher than a wear resistance of the spool body. According to this structure, it is possible to reduce the wearing of the spool caused by the axial end face of the spool rubbing against the actuator when the spool axially moves under the pressure applied to the same end face of the spool from the actuator. Further, since the attachment and the spool body are separate from each other, the higher wear resistance at the axial end portion of the spool can be achieved by increasing only the wear resistance of the attachment. If the attachment and the spool body were integrally formed, it would be necessary to increase the wear resistance of the entire spool including the attachment and the spool body, and this may result in an increase in the manufacturing cost. According to the structure described above, in contrast, such an increase in the manufacturing cost can be avoided.

The hydraulic control apparatus described above may be such that the attachment is heat-treated such that the wear resistance of the attachment is higher than the wear resistance of the spool body. According to this structure, since the attachment and the spool body are separate from each other, the heating treatment can be applied to the attachment while the attachment is separate from the spool body. If the attachment and the spool body were integrally formed, it would be necessary to apply the heating treatment to the entire spool including the attachment and the spool body, and the heating treatment may distort the spool body, resulting, possibly, in a decrease in the accuracy in forming the spool body. According to the above-described structure, such a decrease in the accuracy in forming the spool body can be avoided by applying the heating treatment to the attachment while the attachment is separate from the spool body.

The hydraulic control apparatus described above may be such that the attachment is produced by pressing a plate material. According to this structure, the attachment can be easily produced. Further, in the attachment thus produced, a communication portion is formed, and the communication portion serves as the outlet of the drain passage, which is provided at the radial side face of the axial end portion of the spool, when the attachment is fixed at the spool body. Therefore, an attachment having such a communication portion can be easily produced.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

The first example embodiment of the invention will be described with reference to FIGS. 1 to 6. In the first example embodiment, the invention is embodied as a hydraulic control apparatus that controls the hydraulic pressure applied to a variable valve timing mechanism for a motor vehicle engine.

Figure 1:
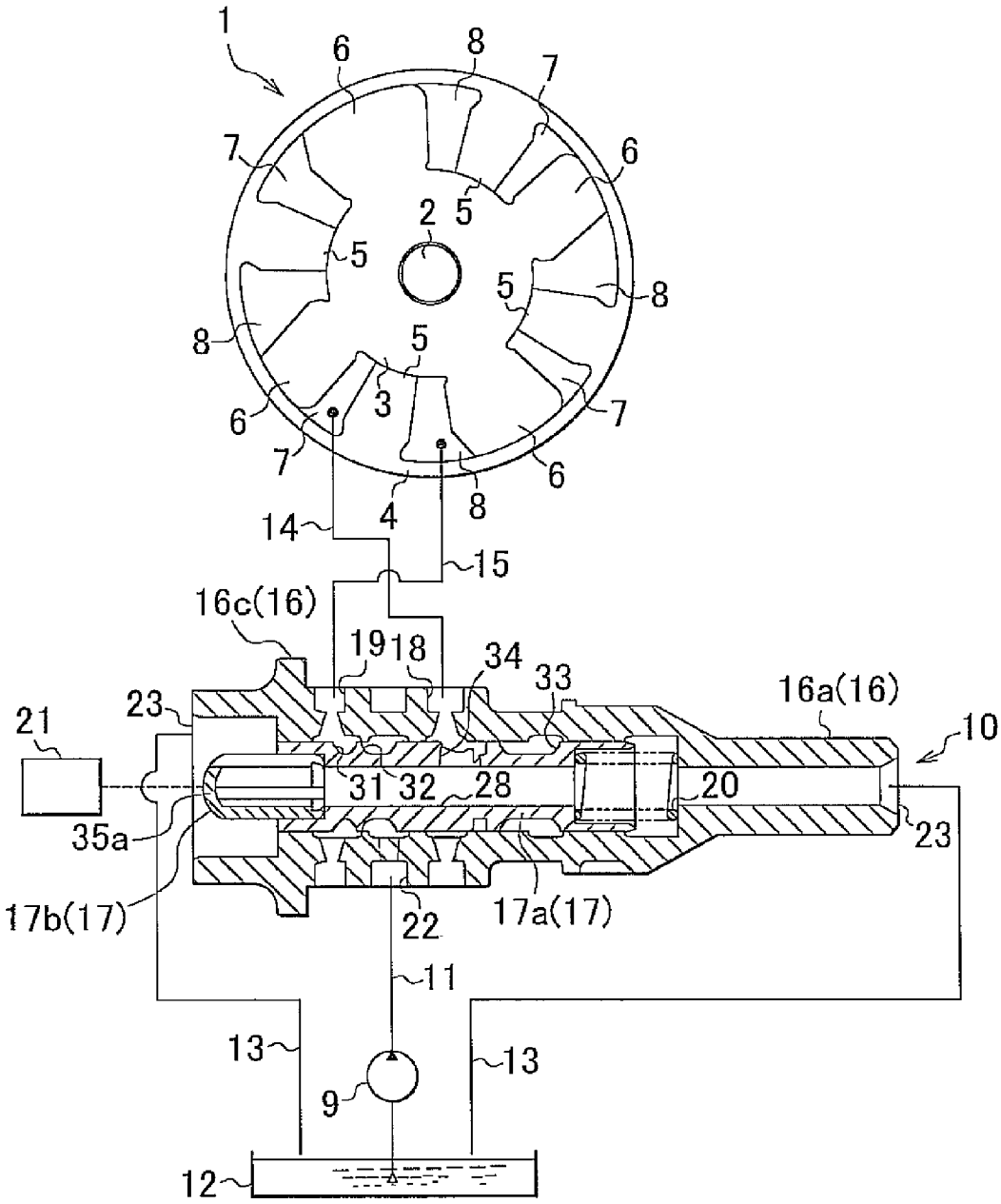
FIG. 1 is a view schematically showing the variable valve timing mechanism and the hydraulic circuit for driving the variable valve timing mechanism in the first example embodiment of the invention.

Referring to FIG. 1, a variable valve timing mechanism 1 includes a moveable member 3 bolted to a camshaft 2 of an internal combustion engine, and a case 4 which is arranged, coaxially with the camshaft 2, to surround the moveable member 3 and to which the rotation of the crankshaft of the internal combustion engine is transferred. It is to be noted that the camshaft 2 may be, for example, an intake camshaft. The case 4 has a plurality of protrusions 5 that are formed such that they protrude from the inner peripheral face of the case 4 toward the axis of the camshaft 2 and are circumferentially arranged at predetermined intervals. Meanwhile, the moveable member 3 has a plurality of vanes 6 that are formed such that they protrude in the directions away from the axis of the camshaft 2 and are located between the respective protrusions 5. Thus, the spaces between the respective protrusions 5 in the case 4 are divided by the vanes 6 into advance hydraulic chambers 7 and retard hydraulic chambers 8.

As the oil is fed to the advance hydraulic chambers 7 while the oil in the retard hydraulic chambers 8 is drained, the moveable member 3 rotates clockwise, as viewed in FIG. 1, relative to the case 4, whereby the rotational phase of the camshaft 2 relative to the crankshaft shifts toward the advance side, that is, the operation timing of the engine valves of the internal combustion engine (the intake valves in this example embodiment) is advanced. Conversely, as the oil is fed to the retard hydraulic chambers 8 while the oil in the advance hydraulic chambers 7 is drained, the moveable member 3 rotates counterclockwise, as viewed in FIG. 1, relative to the case 4, whereby the rotational phase of the camshaft 2 relative to the crankshaft shifts toward the retard side, that is, the operation timing of the engine valves of the internal combustion engine is retarded.

The oil is fed to and drained from the variable valve timing mechanism 1 via multiple oil passages constituting the hydraulic circuit connecting the variable valve timing mechanism 1 to an oil pump 9. The hydraulic circuit includes an oil control valve 10 that is driven by an actuator 21 to change the state of oil feeding to the variable valve timing mechanism 1 and the state of oil drainage from the variable valve timing mechanism 1 (will be collectively referred to as "the state of oil feeding-drainage" where necessary). That is, the oil control valve 10 is driven by the actuator 21 to change the state of oil feeding-drainage for the variable valve timing mechanism 1. In this way, the variable valve timing mechanism 1 is hydraulically driven to operate as described above. It is to be noted that the oil control valve 10 and the actuator 21 each function as a portion of the hydraulic control apparatus that controls the hydraulic pressure applied to the variable valve timing mechanism 1 to drive the variable valve timing mechanism 1.

The oil control valve 10 is connected to the oil pump 9 via an oil-feed passage 11. The oil control valve 10 is connected via oil-drain passages 13 to an oil pan 12 that stores therein the oil to be pumped up by the oil pump 9. The oil control valve 10 is also connected to the advance hydraulic chambers 7 of the variable valve timing mechanism 1 via an advance oil passage 14 and to the retard hydraulic chambers 8 of the variable valve timing mechanism 1 via a retard oil passage 15. The oil control valve 10 includes a housing 16 having ports 18, 19, 22, and 23 that are connected to the above-described oil passages 11, 13, 14, and 15, and an elongated spool 17 that is disposed in the housing 16. The spool 17 axially moves as an axial end face of the spool 17 is pressed. As the spool 17 thus moves, the state of connections between the ports 18, 19, 22, and 23 of the housing 16 changes, whereby the state of oil feeding-drainage for the variable valve timing mechanism 1 changes accordingly.

The axial movement of the spool 17 is accomplished by a coil spring 20 that is disposed in the housing 16 and axially urges the spool 17 and the actuator 21 that presses the spool 17 against the urging force of the coil spring 20. More specifically, the actuator 21 presses the spool 17 via one of the axial end faces of the spool 17 (i.e., the end face in the left side of FIG. 1 in this example embodiment) against the urging force of the coil spring 20. As the pressure that the actuator 21 applies to the spool 17 is adjusted, the spool 17 axially moves so as to bring the pressure from the actuator 21 and the urging force of the coil spring 20 into equilibrium. This is how the axial position of the spool 17 is adjusted. As such, the state of connections between the ports 18, 19, 22, and 23 of the housing 16 can be changed by moving the spool 17 to a target axial position.

More specifically, for example, the axial position of the spool 17 is adjusted such that the port 22 to which the oil-feed passage 11 is connected and the port 18 to which the advance oil passage 14 is connected are connected to each other and the ports 23 to which the respective oil-drain passages 13 are connected and the port 19 to which the retard oil passage 15 is connected are connected to each other. In this case, in the variable valve timing mechanism 1, the oil is fed to the advance hydraulic chambers 7 while the oil in the retard hydraulic chambers 8 is drained, and therefore the moveable member 3 of the variable valve timing mechanism 1 rotates clockwise, as viewed in FIG. 1, relative to the case 4, thereby advancing the valve timing of the internal combustion engine. On the other hand, the axial position of the spool 17 may be adjusted such that the port 22 to which the oil-feed passage 11 is connected and the port 19 to which the retard oil passage 15 is connected are connected to each other and the ports 23 to which the respective oil-drain passages 13 are connected and the port 18 to which the advance oil passage 14 is connected are connected to each other. In this case, in the variable valve timing mechanism 1, the oil is fed to the retard hydraulic chambers 8 while the oil in the advance hydraulic chambers 7 is drained, and therefore the moveable member 3 of the variable valve timing mechanism 1 rotates counterclockwise, as viewed in FIG. 1, relative to the case 4, thereby retarding the valve timing of the internal combustion engine.

Meanwhile, a drain passage 28 through which the oil that has entered the housing 16 from the variable valve timing mechanism 1 is drained is formed in the spool 17 of the oil control valve 10 such that the drain passage 28 extends in the axial direction of the spool 17. It is to be noted that the drain passage 28 is formed such that a larger passage area for improving the oil drainage efficiency can be obtained, and the region where the drain passage 28 is formed can be secured. As described above, the axial end face of the spool 17 on the side where the actuator 21 is present is pressed by the actuator 21, and therefore the outlet of the drain passage 28 formed in the spool 17 cannot be provided at the same axial end face. For this reason, the outlet of the drain passage 28 formed in the spool 17 is provided at a radial side face of the axial end portion of the spool 17 on the side where the actuator 21 is present.

Further, oil grooves 31, 32, and 33 each extending over the entire circumference of the outer peripheral face of the spool 17 are formed on the spool 17 to enable the state of connections between the ports 18, 19, 22, and 23 to be changed by adjusting the axial position of the spool 17 as mentioned above. Further, a hole 34, which extends in the radial direction of the spool 17, is formed in the spool 17 at a position near the axial center of the spool 17 such that the oil that has been drained from the variable valve timing mechanism 1 and then entered the housing 16 is delivered to the drain passage 28 in the spool 17 via the hole 34.

Meanwhile, it is required that the variable valve timing mechanism 1 have a high operation response and the possibility of oil leaks at the oil passages in the hydraulic circuit that are present between the variable valve timing mechanism 1 and the oil control valve 10 (i.e., the advance oil passage 14 and the retard oil passage 15) be reduced. To satisfy such requirements, preferably, the lengths of these oil passages in the hydraulic circuit are reduced. Thus, in this example embodiment, in order to reduce the lengths, a bolt-integrated oil control valve that serves also as a bolt for fixing the moveable member 3 of the variable valve timing mechanism 1 to the camshaft 2 is used as the oil control valve 10.

Next, how the moveable member 3 is fixed to the camshaft 2 using the bolt-integrated oil control valve 10 will be described in detail with reference to FIG. 2.

Figure 2:
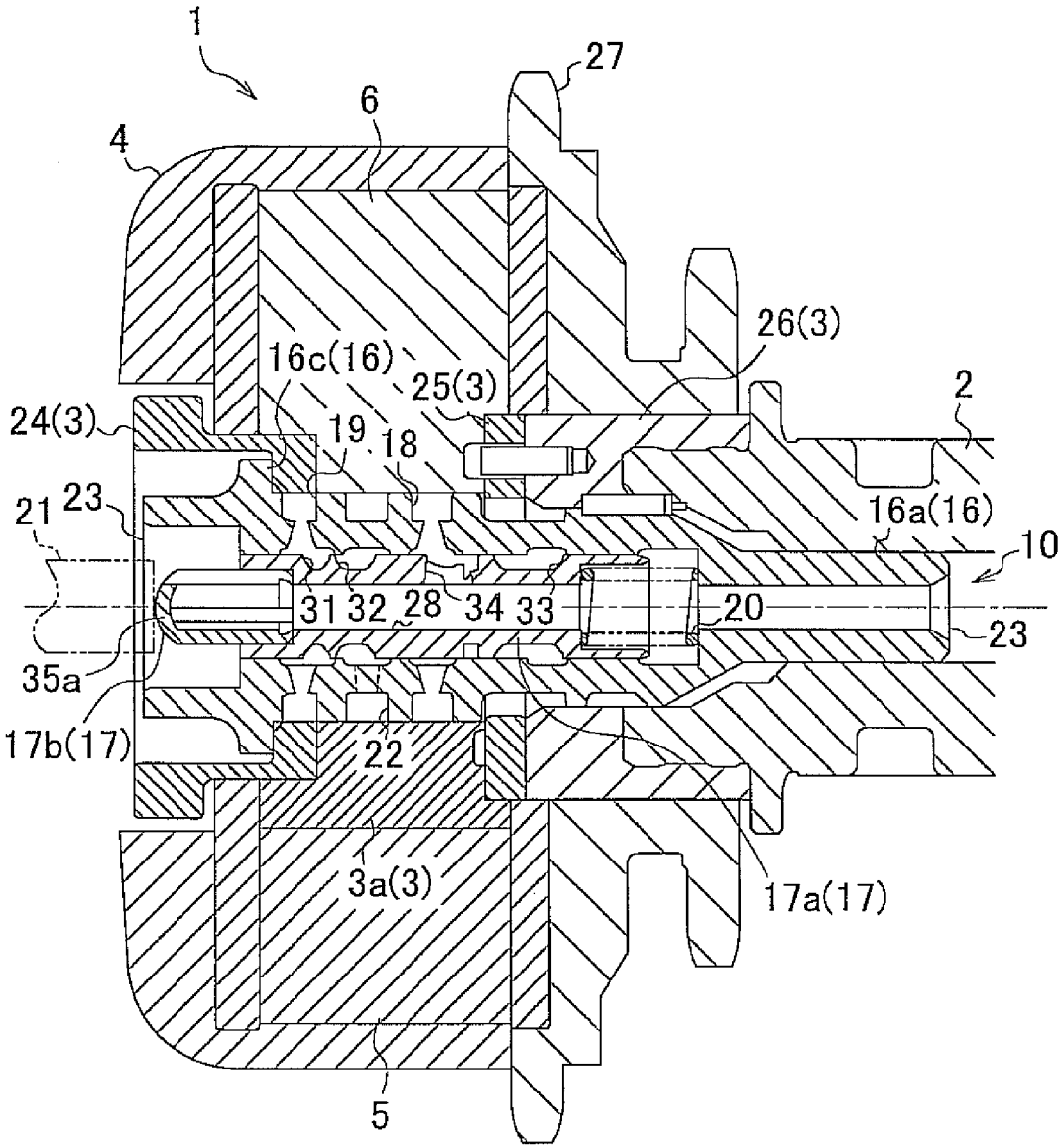
FIG. 2 is a sectional view illustrating how the moveable member of the variable valve timing mechanism is fixed.

Referring to FIG. 2, a bolt portion 16*a* that is screwed into an end portion of the camshaft 2 is formed at one end (the right end, as viewed in FIG. 2) of the housing 16 of the oil control valve 10. A flange portion 16*c* is formed at the other end (the left end, as viewed in FIG. 2) of the housing 16. When the bolt portion 16*a* is screwed into the end portion of the camshaft 2, the moveable member 3 is sandwiched between the flange portion 16*c* and the end face of the camshaft 2 and thus fixed in position.

The bolt portion 16*a* of the oil control valve 10 is screwed into the end portion of the camshaft 2. The moveable member 3, which is sandwiched between the end face of the camshaft 2 and the flange portion 16*c* of the oil control valve 10, includes a front bush 24, a rotor 3*a*, a rear bush 25, and a support 26. The vanes 6 are formed at the rotor 3*a* of the moveable member 3. The front bush 24 is disposed between the rotor 3*a* and the flange portion 16*c*. The rear bush 25 and the support 26 are disposed between the rotor 3*a* and the end face of the camshaft 2. When the bolt portion 16*a* of the oil control valve 10 is screwed into the end portion of the camshaft 2, the rotor 3*a*, the front bush 24, the rear bush 25, and the support 26 of the moveable member 3 are fixed in the axial direction of the camshaft 2 such that they can rotate as one relative to the camshaft 2.

The support 26 supports a sprocket 27 via which the rotation of the crankshaft of the internal combustion engine is transferred, such that the sprocket 27 is rotatable relative to the camshaft 2. Further, the case 4 of the variable valve timing mechanism 1 is fixed to the sprocket 27. When the rotation of the crankshaft of the internal combustion engine is transferred to the sprocket 27, the sprocket 27 and the case 4 rotate about the axis of the camshaft 2. The rotation of the sprocket 27 and the case 4 is transferred to the moveable member 3 via the oil in the case 4, and then to the camshaft 2. Thus, as the moveable member 3 of the variable valve timing mechanism 1 is rotated relative to the case 4, the rotational phase of the camshaft 2 relative to the crankshaft shifts, thereby changing the valve timing of the internal combustion engine accordingly.

In the hydraulic control apparatus including the oil control valve 10 and the actuator 21 as described above, the oil control valve 10 is fixed to the camshaft 2 of the internal combustion engine, and thus the oil control valve 10 and the camshaft 2 rotate as one. Thus, the spool 17 of the oil control valve 10 also rotates as one with the camshaft 2. Meanwhile, the actuator 21 is provided outside the camshaft 2 and contacts the axial end face of the spool 17 of the oil control valve 10. Thus, as the spool 17 of the oil control valve 10 rotates with the camshaft 2 during operation of the internal combustion engine, the axial end face of the rotating spool 17 rubs against the actuator 21.

Next, the structure of the spool 17 of the oil control valve 10 will be described in detail. In the spool 17, the drain passage 28 extending axially is formed, and the outlet of the drain passage 28 is provided at the radial side face of the actuator -side-axial end portion of the spool 17. With this arrangement, the path of the drain passage 28 changes its direction (i.e., curves) in the vicinity of the actuator -side outlet of the drain passage 28 from the axial direction of the spool 17 to the radial direction of the spool 17. For such a reason, inevitably, the internal structure of the actuator -side axial end portion of the spool 17 is complicated, and therefore there is a possibility of an increase in the time and effort required for fabricating the inside of the actuator -side axial end portion of the spool 17, resulting in an increase in the manufacturing cost.

To counter this, in this example embodiment, the spool 17 includes a spool body 17*a* that is elongated, and an attachment 17*b* that is a member separate from the spool body 17*a* and fixed at the actuator -side axial end portion of the spool body 17*a*. The attachment 17*b* is higher in wear resistance than the spool body 17*a*. More specifically, the wear resistance of the attachment 17*b* can be made higher than that of the spool body 17*a* by, for example, making the attachment 17*b* of a material having a higher wear resistance than that of the material of the spool body 17*a* or by applying a heating treatment to the attachment 17*b*.

With the spool 17 structured as described above, it is possible to fabricate the inside of the attachment 17*b*, corresponding to the inside of the actuator -side axial end portion of the spool 17, while the attachment 17*b* is separate from the spool body 17*a*. Then, after fabricating the inside of the attachment 17*b*, the attachment 17*b* is fixed to the axial end portion of the spool body 17*a*. Thus, the inside of the actuator side-axial end portion of the spool 17 is fabricated. That is, because the inside of the attachment 17*b* corresponding to the inside of the actuator side-axial end portion of the spool 17 can be fabricated while the attachment 17*b* is separate from the spool body 17*a*, the inside of the actuator side-axial end portion of the spool 17 can be easily fabricated.

Figure 3A:
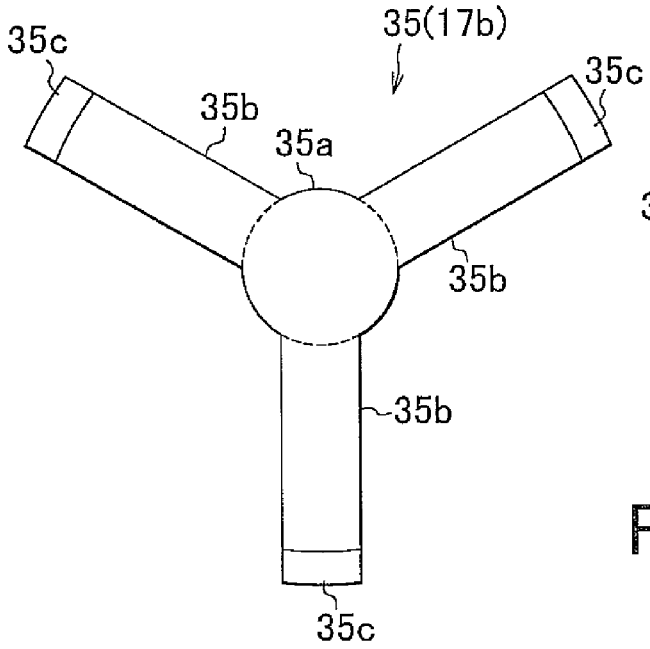
FIG. 3A is a top view of the material of which the attachment in the first example embodiment of the invention is made.
Figure 3B:
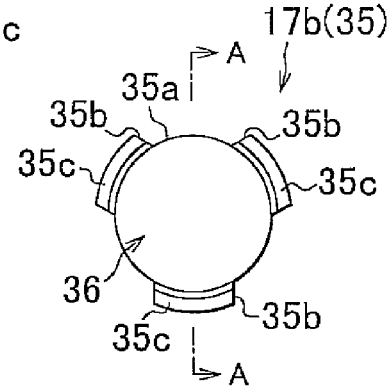
FIG. 3B is a front view of the attachment in the first example embodiment of the invention, as viewed from the side where the length adjustor portions are present.
Figure 3C:
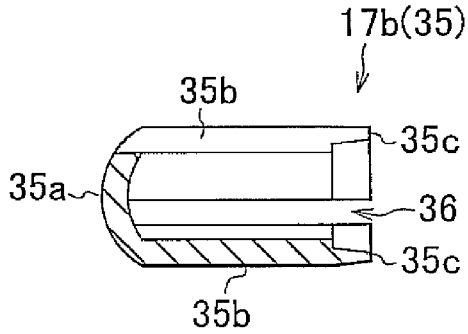
FIG. 3C is a sectional view of the attachment, which is taken along the direction indicated by the arrows A in FIG. 3B.
Figure 4:
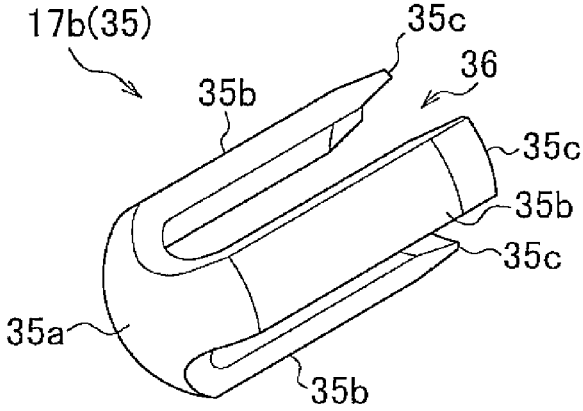
FIG. 4 is a perspective view of the attachment in the first example embodiment of the invention.

The attachment 17*b* may be produced and fixed to the spool body 17*a* through, for example, the following processes. First, a plate material 35 shaped as shown in FIG. 3A is produced by punching a metal plate. The material 35 has a disc-shaped center portion 35*a*, three body portions 35*b* arranged equiangularly with respect to the center portion 35*a* and extending radially from the center portion 35*a*, and length adjuster portions 35*c* provided at the tips of the respective body portions 35*b*. It is to be noted that the burrs that are formed when punching the material 35 may be used as the length adjuster portions 35*c*.

Next, the respective body portions 35*b* are bent upward, that is, bent to extend upward from the center portion 35*a*, by pressing them with respect to the center portion 35*a* along the boundaries between the respective body portions 35*b* and the center portion 35*a* of the material 35 (refer to the broken curves in FIG. 3A). In this way, the attachment 17*b* is formed into the shape shown in FIGS. 3B, 3C, and 4. Thus formed, the attachment 17*b* defines therein a communication portion 36 (see FIGS. 3B, 3C, and 4). When the attachment 17*b* is fixed at the spool body 17*a*, the communication portion 36 serves as the outlet of the drain passage 28, which is provided at the radial side face of the axial end portion of the spool 17.

Subsequently, a heating treatment is applied to the entirety of the attachment 17*b*. This is for increasing the wear resistance of the attachment 17*b*, especially that of the center portion 35*a* that is to contact the actuator 21. Through this process, the wear resistance of the attachment 17*b* is made higher than that of the spool body 17*a*. It is to be noted that the above heating treatment for the attachment 17*b* may be omitted in a case where the attachment 17*b* (the material 35) is made of a material having a higher wear resistance than that of the material of the spool body 17*a*.

Figure 5:
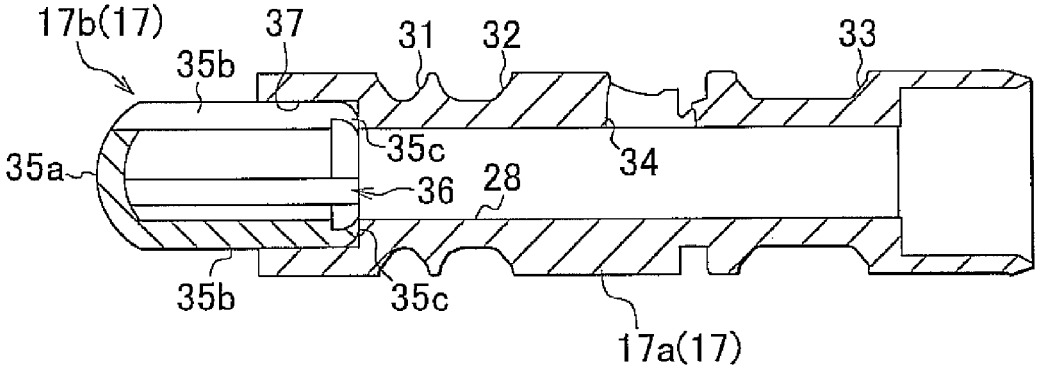
FIG. 5 is a sectional view illustrating how the attachment in the first example embodiment is fixed to the spool body.
Figure 6:
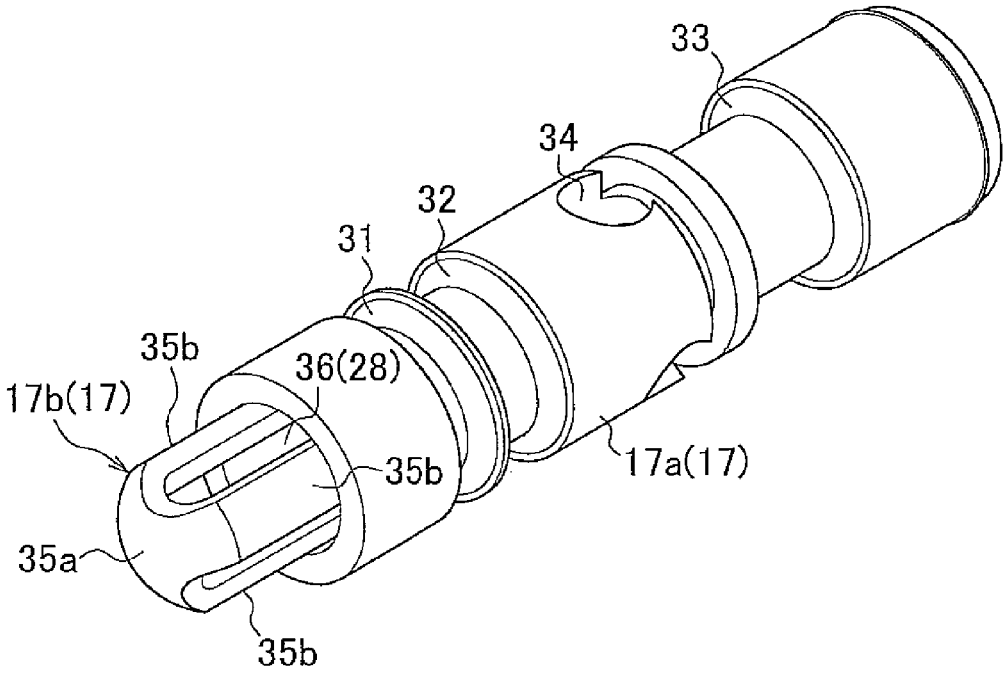
FIG. 6 is a perspective view illustrating how the attachment in the first example embodiment of the invention is fixed to the spool body.

Then, the attachment 17*b* is set in such a position that the length adjustor portions 35*c* face the axial end face of the spool body 17*a* shown in FIG. 5, that is, the end face in the left side as viewed in FIG. 5 (i.e., the actuator -side end face). A fit portion 37 that opens to the side where the attachment 17*b* is present and is larger in inner diameter than the drain passage 28 in the spool body 17*a* is formed at the attachment -side end portion of the spool body 17*a*. The length adjustor portions -side portion of the attachment 17*b* is press-fit into the fit portion 37 of the spool body 17*a* along its inner peripheral face, whereby the attachment 17*b* is fixed to the spool body 17*a*. It is to be noted that the fixing position of the attachment 17*b* in the axial direction of the spool body 17*a*, that is, the axial length of the spool 17 can be adjusted by buckling the length adjustor portions 35*c* of the attachment 17*b* when press-fitting the attachment 17*b* into the fit portion 37 of the spool body 17*a*.

Manufactured by fixing the attachment 17*b* to the spool body 17*a* as described above, the spool 17 is used as illustrated in FIG. 2. That is, as one of the parts constituting the oil control valve 10, the spool 17 rotates as one with the camshaft 2 and receives, via the attachment -side end portion, the pressure from the actuator 21 arranged outside the camshaft 2. Therefore, the attachment side-axial end portion of the spool 17 (i.e., the center portion 35*a* of the attachment 17*b*) contacts the actuator 21, and thus the center portion 35*a* of the attachment 17*b* rubs against the actuator 21 as the camshaft 2 rotates.

The first example embodiment described above provides the following effects. According to the first example embodiment, the spool 17 of the oil control valve 10 is manufactured by fixing the attachment 17*b*, which is separate from the spool body 17*a*, to the actuator side-axial end portion of the elongated spool body 17*a*. With the spool 17 thus manufactured, the inside of the attachment 17*b*, corresponding to the inside of the actuator side-axial end portion of the spool 17, can be fabricated while the attachment 17*b* is separate from the spool body 17*a*. After fabricating the inside of the attachment 17*b*, the attachment 17*b* is fixed to the axial end portion of the spool body 17*a*. Thus, the inside of the actuator side-axial end portion of the spool 17 is fabricated. That is, because the inside of the attachment 17*b*, corresponding to the inside of the actuator side-axial end portion of the spool 17, can be fabricated while the attachment 17*b* is separate from the spool body 17*a*, the inside of the actuator side-axial end portion of the spool 17 can be easily fabricated.

According to the first example embodiment, further, the heating treatment is applied to the attachment 17*b* to make its wear resistance higher than that of the spool body 17*a*. Therefore, it is possible to reduce the wearing of the spool 17 caused by the axial end face of the spool 17 rubbing against the actuator 21 when the spool 17 axially moves under the pressure applied to the same end face of the spool 17 from the actuator 21. Further, since the attachment 17*b* and the spool body 17*a* are separate from each other, the higher wear resistance at the axial end portion of the spool 17 can be achieved by increasing only the wear resistance of the attachment 17*b* as described above. If the attachment 17*b* and the spool body 17*a* were integrally formed, it would be necessary to increase the wear resistance of the entire spool 17 including the attachment 17*b* and the spool body 17*a*, and this may result in an increase in the manufacturing cost. According to the first example embodiment, in contrast, such an increase in the manufacturing cost can be avoided.

According to the first example embodiment, further, the heating treatment that is applied to the attachment 17*b* to make its wear resistance higher than that of the spool body 17*a* can be performed while the attachment 17*b* is separate from the spool body 17*a*. If the attachment 17*b* and the spool body 17*a* were integrally formed, it would be necessary to apply the heating treatment to the entirety of the spool 17, and the heating treatment may distort the spool body 17*a*, resulting, possibly, in a decrease in the accuracy in forming the spool body 17*a* and thus in positional deviations of the oil grooves 31, 32, and 33, and hole 34 of the spool 17 in the axial direction of the spool 17. In such a case, the oil feeding to the variable valve timing mechanism 1 and the oil drainage from it may not be performed properly through the operation of the oil control valve 10. According to the first example embodiment, such problems resulting from a decrease in the accuracy in forming the spool 17 can be avoided by applying the heating treatment to the attachment 17*b* while the attachment 17*b* is separate from the spool body 17*a*.

According to the first example embodiment, further, the attachment 17*b* is produced by pressing the plate material 35. Therefore, the attachment 17*b* can be easily produced. Further, the communication portion 36 is formed in the attachment 17*b*. The communication portion 36 serves as the outlet of the drain passage 28, which is provided at the radial side face of the axial end portion of the spool 17, when the attachment 17*b* is fixed at the spool body 17*a*. Thus, the attachment 17*b* having the communication portion 36 can be easily produced.

According to the first example embodiment, further, when the attachment 17*b* is fixed by being press-fit into the spool body 17*a*, the axial length of the spool 17 can be adjusted by buckling the length adjustor portions 35*c* of the attachment 17*b*. Therefore, the axial length of the spool 17 can be accurately adjusted to a desired value. Further, the burrs that are formed when punching the material 35 to make the attachment 17*b* may be used as the length adjustor portions 35*c*. Thus, the length adjustor portions 35*c* can be produced easily.

Figure 7A:
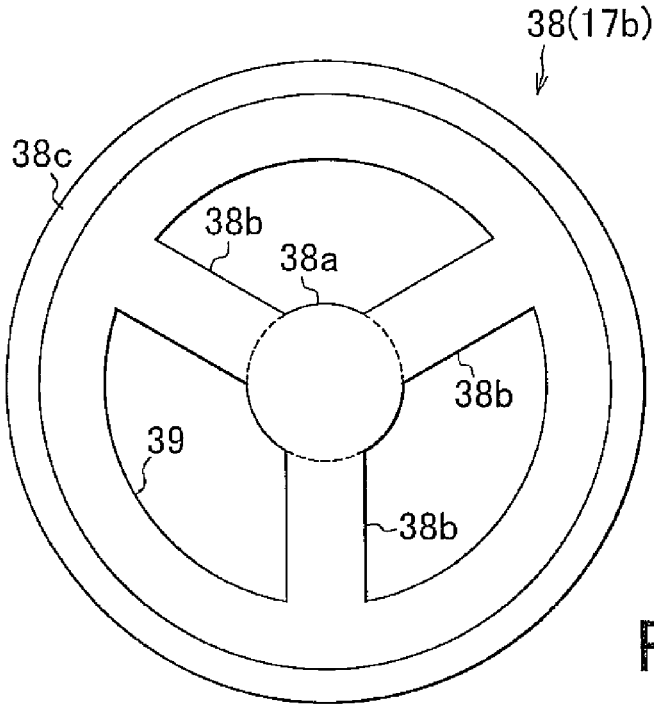
FIG. 7A is a top view of the material of which the attachment in the second example embodiment is made.

Next, the second example embodiment of the invention will be described with reference to FIGS. 7 to 10. In the second example embodiment, the shape of the attachment 17*b* is different from that in the first example embodiment. FIG. 7A shows a material 38 of which the attachment 17*b* in the second example embodiment is made. As the material 35 in the first example embodiment, the material 38 is produced by punching a metal plate, and the material 38 includes a center portion 38*a* and body portions 38*b*. However, unlike in the material 35 in the first example embodiment, the body portions 38*b* are connected, at their ends, to each other via a ring portion 39, and the outer edge of the ring portion 39 is used as a length adjustor portion 38*c*, in the material 38.

Figure 7B:
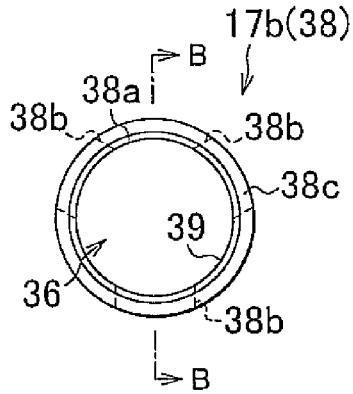
FIG. 7B is a front view of the attachment in the second example embodiment, as viewed from the side where the length adjustor portions are present.
Figure 7C:
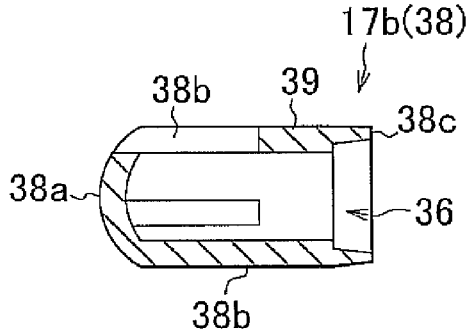
FIG. 7C is a sectional view of the attachment, which is taken along the direction indicated by the arrows B in FIG. 7B.
Figure 8:
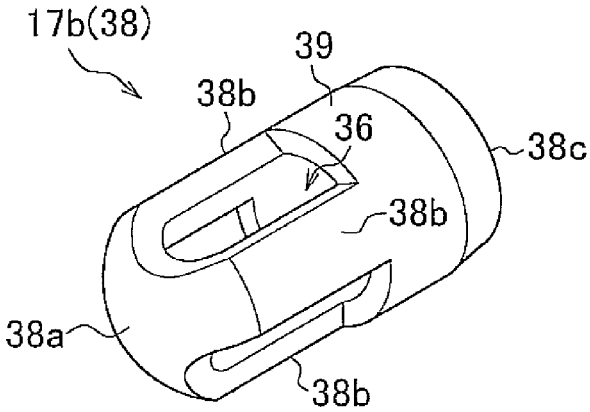
FIG. 8 is a perspective view of the attachment in the second example embodiment.
Figure 9:
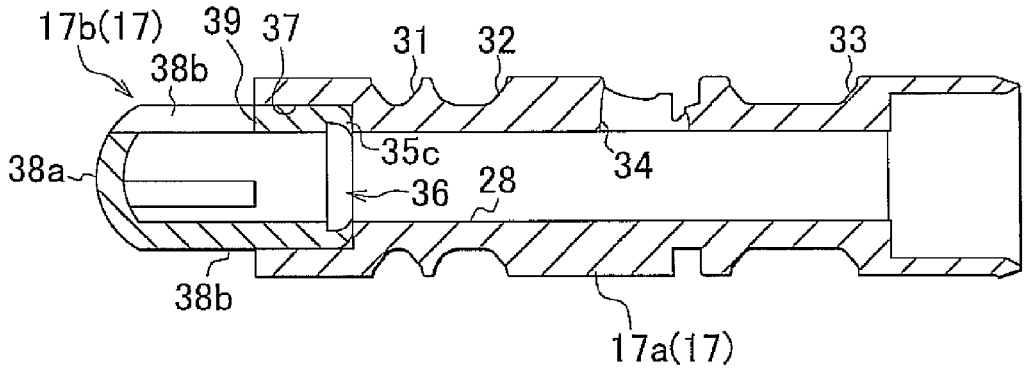
FIG. 9 is a sectional view illustrating how the attachment in the second example embodiment is fixed to the spool body.
Figure 10:
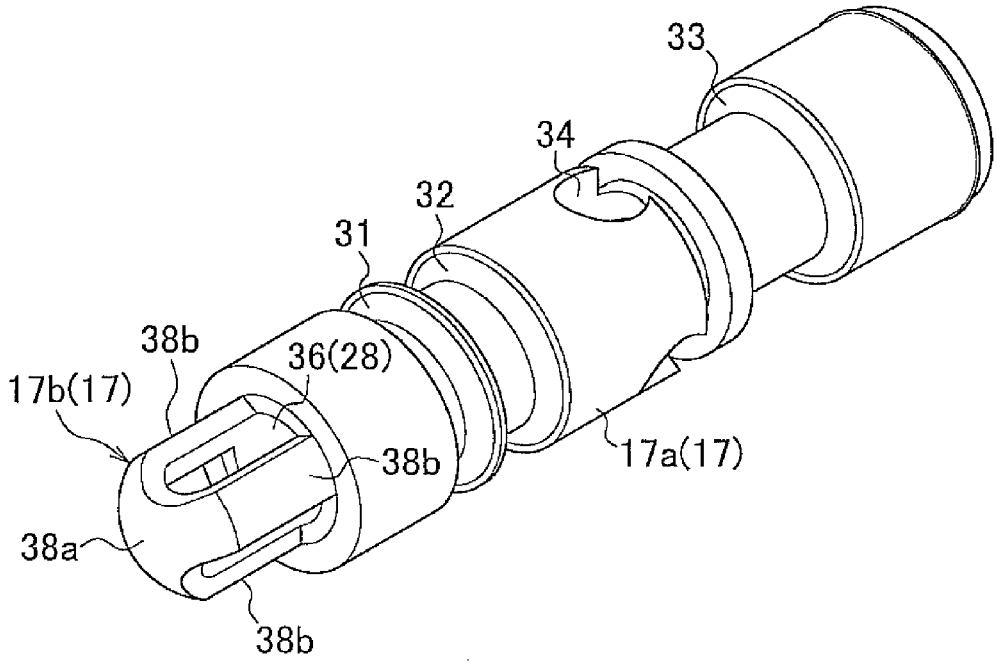
FIG. 10 is a perspective view illustrating how the attachment in the second example embodiment is fixed to the spool body.

The material 38 is set between the upper and lower dies of a pressing machine and then pressed, whereby the attachment 17*b* shaped as shown in FIGS. 7B, 7C, and 8 is produced. At this time, due to the presence of the ring portion 39, the length adjustor portion -side portion of the attachment 17*b* is made circular. Thus, the entire outer circumferential face of the ring portion 39 of the attachment 17*b* is joined to the entire inner circumferential face of the fit portion 37 of the spool body 17*a* when the ring portion 39 is press-fit into the fit portion 37 to fix the attachment 17*b* to the spool body 17*a* as shown in FIGS. 9 and 10.

The second example embodiment provides the following effect, as well as those of the first example embodiment. First, since the attachment 17*b* is fixed to the spool body 17*a* by press-fitting the ring portion 39 into the fit portion 37 such that the entire outer circumferential face of the ring portion 39 of the attachment 17*b* is joined to the entire inner circumferential face of the fit portion 37 of the spool body 17*a*, the attachment 17*b* can be fixed to the spool body 17*a* more reliably.

Meanwhile, for example, the foregoing example embodiments may be modified as follows. The length adjustor portions 35*c* and 38*c* of the attachment 17*b* may be portions that are provided at the materials 35 and 38 exclusively for adjusting the length of the spool 17 (the fixing position of the spool 17), instead of the burrs formed when punching the materials 35 and 38.

While the attachment 17*b* is produced by pressing the material 35 or 38 in the foregoing example embodiments, the attachment 17*b* may alternatively be produced by casting or forging, or by cutting a material. Further, while the wear resistance of the attachment 17*b* is increased by making the attachment 17*b* of a material having a higher wear resistance or by applying a heating treatment to the attachment 17*b* in the foregoing example embodiments, the wear resistance of the attachment 17*b* may alternatively be increased by providing a coat on the attachment 17*b* for increasing its wear resistance.

Further, while the wear resistance of the attachment 17*b* is made higher than that of the spool body 17*a* in the foregoing example embodiments, the wear resistance of the attachment 17*b* is not necessarily made higher than that of the spool body 17*a*. Further, while the attachment 17*b* is fixed to the spool body 17*a* by press-fitting in the foregoing example embodiments, various other methods, such as caulking, may be used alternatively.

Further, the attachment 17*b* may be detachably fixed at the spool body 17*a*. That is, in the hydraulic control apparatus, the oil control valve 10 is fixed at the camshaft 2 of the internal combustion engine, and the oil control valve 10 rotates as one with the camshaft 2. On the other hand, in the hydraulic control apparatus, the actuator 21 is provided outside the camshaft 2 and contacts the axial end face of the spool 17 of the oil control valve 10, that is, the end face of the attachment 17*b* of the spool 17. Therefore, during operation of the internal combustion engine, as the spool 17 of the oil control valve 10 rotates with the camshaft 2, the axial end face of the rotating spool 17 rubs against the actuator 21. Thus, the axial end face of the spool 17 is likely to be worn out. Thus, by detachably fixing the attachment 17*b*, where the axial end face of the spool 17 is formed, at the spool body 17*a* as mentioned above, it is possible to replace the attachment 17*b* with a new one even if the axial end face of the spool 17 is worn out.

Further, while the bolt-integrated oil control valve serving also as a bolt for fixing the moveable member 3 of the variable valve timing mechanism 1 to the camshaft 2 is used as the oil control valve 10 in the foregoing example embodiments, the invention may be applied also to oil control valves having no such feature. In this case, the oil control valve is provided outside the camshaft 2.

The invention may be applied also to various oil control valves and hydraulic control apparatuses that change the state of oil feeding-drainage for hydraulic devices other than variable valve timing mechanisms structured like the variable valve timing mechanism 1 described above.

What is claimed is:

1. An oil control valve comprising:

a housing that is connected to an oil passage via which an oil is fed to and drained from a hydraulic device;

an elongated spool that changes a state of oil feeding-drainage for the hydraulic device by moving in the housing; and a drain passage which is formed in the spool such that the drain passage extends in an axial direction of the spool and an outlet of the drain passage is provided at a radial side face of an axial end portion of the spool, and via which the oil that has entered the housing from the hydraulic device is drained, wherein the spool includes an elongated spool body, and an attachment that is separate from the spool body and is fixed at an axial end portion of the spool body;

wherein a communication portion is provided in the attachment, and the communication portion serves as the outlet of the drain passage, which is provided at the radial side face of the axial end portion of the spool, when the attachment is fixed at the spool body.

2. The oil control valve according to claim 1, wherein a wear resistance of the attachment is higher than a wear resistance of the spool body.

3. The oil control valve according to claim 2, wherein the attachment is heat-treated such that the wear resistance of the attachment is higher than the wear resistance of the spool body.

4. The oil control valve according to claim 1, wherein the attachment is produced by pressing a plate material such that the communication portion is provided in the attachment.

5. A hydraulic control apparatus comprising:

an oil control valve that is fixed at an end portion of a camshaft of an internal combustion engine and that changes a state of oil feeding-drainage for a hydraulic device; and an actuator that is provided outside the camshaft and that drives the oil control valve, wherein:

the oil control valve is driven by moving an elongated spool, which is disposed in a housing, in an axial direction of the spool by a pressure applied to an axial end face of the spool from the actuator;

a drain passage via which an oil that has entered the housing from the hydraulic device is drained is formed in the spool such that the drain passage extends in the axial direction of the spool and an outlet of the drain passage is provided at a radial side face of an axial end portion of the spool; and the spool includes an elongated spool body, and an attachment that is separate from the spool body and is fixed at an axial end portion of the spool body on a side where the actuator is present, wherein a communication portion is provided in the attachment, and the communication portion serves as the outlet of the drain passage, which is provided at the radial side face of the axial end portion of the spool, when the attachment is fixed at the spool body.

6. The hydraulic control apparatus according to claim 5, wherein a wear resistance of the attachment is higher than a wear resistance of the spool body.

7. The hydraulic control apparatus according to claim 6, wherein the attachment is heat-treated such that the wear resistance of the attachment is higher than the wear resistance of the spool body.

8. The hydraulic control apparatus according to claim 5, wherein the attachment is produced by pressing a plate material such that the communication portion is provided in the attachment.

* * * * *